US005576155A

United States Patent [19]

Muessig-Pabst et al.

[11] Patent Number: 5,576,155

[45] Date of Patent: Nov. 19, 1996

[54] FAST-PROCESSING PHOTOGRAPHIC RECORDING MATERIAL FOR MEDICAL RADIOGRAPHY

[75] Inventors: Thomas Muessig-Pabst, Frankfurt am Main; Manfred A. Schmidt, Dietzenbach, both of Germany

[73] Assignee: Sterling Diagnostic Imaging, Inc., Glasgow, Del.

[21] Appl. No.: 534,363

[22] Filed: Sep. 27, 1995

[30] Foreign Application Priority Data

Oct. 7, 1994 [DE] Germany ..... 44 35 876.8

[51] Int. Cl.[6] ..... G03C 1/46

[52] U.S. Cl. ..... 430/502; 430/503; 430/567; 430/963; 430/966

[58] Field of Search ..... 430/502, 503, 430/567, 963, 966

[56] References Cited

U.S. PATENT DOCUMENTS

| | | | |
|---|---|---|---|
| H674 | 9/1989 | Nagasaki et al. | 430/496 |
| 3,880,665 | 4/1975 | Himmelmann | 96/111 |
| 4,508,818 | 4/1985 | Ogawa et al. | 430/523 |
| 4,797,353 | 1/1989 | Yamada et al. | 430/434 |
| 4,861,702 | 8/1989 | Suzuki et al. | 430/564 |
| 4,897,340 | 1/1990 | Ohtani et al. | 430/403 |
| 4,940,652 | 7/1990 | Nagasaki | 430/403 |
| 5,001,046 | 3/1991 | Honda et al. | 430/567 |
| 5,081,007 | 1/1992 | Sakuma | 430/434 |
| 5,087,694 | 2/1992 | Dumas et al. | 530/354 |
| 5,206,128 | 4/1993 | Arai | 430/523 |
| 5,310,636 | 5/1994 | Ohmatsu et al. | 430/502 |
| 5,318,881 | 6/1994 | Bucci et al. | 430/434 |

*Primary Examiner*—Geraldine Letscher

[57] ABSTRACT

The invention relates to a fast-processing photographic recording material for medical radiography which can be processed within 30 to 60 seconds in a film processor and which has very good photographic and physical properties. The recording material has a) a silver application of at least 5 g/M$^2$, b) a weight ratio of binder coating weight in the silver halide emulsion layer to silver coating weight in the silver halide emulsion layer of at least 1.1, c) a mean grain volume of the silver halide grains used of less than 0.35 mm$^3$ and d) a process water absorption of less than 20 g/M$^2$.

7 Claims, No Drawings

FAST-PROCESSING PHOTOGRAPHIC RECORDING MATERIAL FOR MEDICAL RADIOGRAPHY

FIELD OF INVENTION

The subject matter of this invention is a fast-processing photographic recording material for medical radiography, which stands out for its fast processability and high sensitivity while also displaying very good photographic and physical properties.

BACKGROUND OF THE INVENTION

Medical radiography makes use of photographic recording materials (called X-ray films below) having at least one radiation-sensitive silver halide emulsion layer on both sides of a carrier in combination with reinforcing sheets. The physical and photographic properties of X-ray films determine their suitability in terms of allowing the radiologist to make a reliable diagnosis of diseases.

In addition to the uniform high quality requirements made of today's X-ray films, fast availability of the images developed from them is a significant aspect of the value offered by X-ray films. Fast availability is critical in those instances where pictures which are taken during operations are needed to provide information on the further course of the surgery.

Moreover, in hospitals or large physicians' practices, it is often the case that pictures from several imaging devices such as, for example, X-ray machines, laser cameras, devices for monitor photography and copiers for X-ray films are processed in the same film processor. Therefore, there is a desire for the shortest possible processing times—less than 60 seconds—for X-ray films as well as for other photographic films in such hospitals and physicians' practices.

The processing time of a photographic film depends primarily on the composition of the film in question, on the structure and on the mode of operation of the particular film processor, as well as on the developer solution and the fixing bath used in the film processor. The dryer geometry, drying time of the film processor, and absorption of process water by the particular photographic film all influence the drying of the photographic films in the film processor and these properties are of special importance in this context.

The processing time is defined here as the time that an X-ray film in the standard format having edge lengths of 0.35×0.35 meters needs to pass through a film processor, starting when the X-ray film is pulled in and ending with the complete release of the developed X-ray picture. This period of time is also referred to as the "nose to drop" in the literature.

A photographic silver halide recording material is said to be fast-processing if it can be processed in a film processor within 30 to 60 seconds.

U.S. Pat. No. 4,897,340 describes an example of a roll processor as well as a formulation for a developer used in it as well as a fixing bath suitable for this processing.

In order to reduce the processing time of photographic films, EP-A 0,248,390 proposes the reduction of the total gelatin application to a range from 2.2 to 3.1 g/M$^2$ per side. However, this has a detrimental effect on certain properties of X-ray films such as, for example, wet pressure marks, scratch-resistance, grain, printing desensitization as well as the picture quality of the image made with this material.

As another way to shorten the processing time of X-ray films, it has been suggested to reduce the swelling of the binder by means of greater cross-linking. This measure, however, has a detrimental effect on the photographic properties such as gradation, sensitivity and maximum density.

A simultaneous reduction of binder and silver halide application in the recording material leads to a lower maximum density and a greater print through and thus to worse image sharpness of the picture made with this material. This can only be unsatisfactorily compensated for by using filter dyes, since the filter dyes cannot be completely washed out in the envisioned short processing time and thus they have a negative impact on the picture coloration of the X-ray image made in this manner.

U.S. Pat. No. 4,797,353 proposes another way to quickly process X-ray films which consists of using polymers such as polyacrylamide and/or saccharose in the silver halide or protective layer. These polymers are washed out during the development process.

However, the washable polymers contaminate the processor liquids and are thus disadvantageous. Moreover, such films with a low weight ratio of non-washable binder to silver have poor wet pressure mark properties.

Until now, no photographic recording material has been found for medical radiology that can be processed within 60 seconds with a film roll processor, while also displaying very good physical and photographic properties as well as high picture quality.

The photographic recording materials which have been proposed so far for medical radiology and which can be processed within 60 seconds also yield differing sensitometric data as a function of the processing time. This is not desirable in actual practice since different imaging parameters are needed for different processing speeds.

SUMMARY OF THE INVENTION

The objective of the invention is to provide a photographic recording material for medical radiography which displays very good photographic and physical properties, and which can be processed in less than 60 seconds in a roll processor.

The objective is achieved by a fast-processing photographic silver halide recording material for medical radiography comprising:

a carrier; a silver halide emulsion layer applied to both sides of said carrier wherein said silver halide emulsion layer comprises a binder and silver halide grains having a mean grain volume of less than 0.35 mm$^3$; an auxiliary layer coated on said emulsion layer; a silver coating weight of at least 5.0 g/M$^2$; a binder coating weight wherein a weight ratio of said binder coating weight to said silver coating weight is at least 1.1; wherein said silver halide recording material has a process water absorption of less than 20 g/M$^2$ and said photographic silver halide recording material is processable within 60 seconds in a roll processor.

DETAILED DESCRIPTION OF THE INVENTION

Binder coating weight or silver coating weight is defined as the weight of the sum of the binders or as the weight of the silver in the form of its ions in the layers containing the silver halide crystals, related to the surface unit of the photographic silver halide material. Thus, the binders which are present in the auxiliary layers of the photographic silver halide material are not taken into account in the calculation of the binder application. The values for the binder or silver application are given in grams per square meter and, unless otherwise indicated, relate to the entirety of all layers of the recording material containing silver halide.

A suitable silver coating weight for the fast-processing silver halide recording material according to the invention is at least 5 g/M$^2$. Preferably, a silver coating weight of at least 5.2 g/M$^2$ is used. The range from 5.2 to 6.0 g/M$^2$ is especially preferred.

In a preferred embodiment, the recording material according to the invention contains at least one silver halide emulsion layer on each side of the carrier. In this context, special preference is given to a recording material which contains at least one silver halide emulsion layer on each side of the substrate and in which the silver halide emulsion layers on both sides of the substrate are largely identical.

The silver coating weight can be adjusted, for example, by means of the silver halide concentration in the silver halide emulsion and by means of the layer thickness of the silver halide emulsion layer or silver halide emulsion layers.

Examples of binders which can be used in the various layers of the silver halide recording material are synthetic polymers such as polymers or copolymers made of vinyl alcohol, N-vinyl pyrrolidone, acrylamide, acrylic acid, methacrylic acid, vinyl imidazole, vinyl pyrazole, as well as natural polymers such as casein, gelatin (acidically or alkalinically processed, made of bovine bones or pigskins), cellulose and cellulose derivatives, alginates, albumin, starch, as well as modified polymers such as hydroxyethyl cellulose, hydrolyzed gelatin, chemically modified gelatin as described, for example, in U.S. Pat. No. 5,087,694, chemically modified and hydrolyzed gelatin as described, for example, in DE-B 2,166,605 and U.S. Pat. No. 3,837,861.

Mixtures of binders can also be used in the individual layers. The preferred main component of a binder mixture or as the only binder in the layers of photographic recording materials can be, for instance, gelatin.

The preferred protective colloid used for the silver halide crystals and binder in the emulsion layer is alkalinically processed bovine bone gelatin. It can be ion-exchanged or else not ion-exchanged.

Preferably, a weight ratio of binder or binder mixture to silver of at least 1.1 is used in the silver halide emulsion. In this context, special preference is given to a ratio between 1.1 and 1.4.

This ratio is established, for example, during the production of the silver halide emulsion by means of the amount of binder to be added relative to the amount of silver.

The grain volume of a silver halide emulsion refers to the mean grain volume. This makes it possible to compare different grain shapes such as spheres, cubes, octahedra or plates with each other.

According to the invention, mainly silver halide emulsions are used whose mean grain volume is less than 0.35 mm$^3$. The preferred range in this context lies between 0.05 and 0.35 mm$^3$.

The grain size or grain volume can be determined by means of various methods such as, for example, by means of scanning electron microscopic images of such an emulsion or by means of the process described in German Pat. No. 2,025,147.

The process water absorption of a photographic silver halide recording material can be determined, for example, according to the process described in the embodiments. Another method is described in U.S. Pat. No. 5,001,046. Recording materials according to the invention exhibit a process water absorption of less than 20 grams of water per square meter of recording material. Preferably, however, a recording material is used which has a process water absorption level of less than 18 grams of water per square meter.

The process water absorption of a photographic recording material can be adjusted, for example, by means of the amount of curing agents used to cure the layers present in the recording material. The amount of curing agent required for this purpose can be determined, for example, by means of series tests with different amounts of curing agent.

The silver halide crystals in the silver halide emulsion can have a regular crystal shape such as, for example, cubes, octahedra, cubo-octahedra or tetrahedra, or a less regular shape such as plates or spheres or mixtures of at least two of these shapes. Preferably, silver halide emulsions are used which primarily contain grains with a regular crystal shape and/or spherical silver halide grains. Special preference is given to silver halide emulsions which primarily contain silver halide grains.

Cubes, octahedra, cubo-octahedra and simple twins with (111) and/or (100) bounding faces having an average ratio of the smallest to the largest dimension (aspect ratio) between 1.0:1.1 and 1.0:2.0 and can be considered to be approximately spherical.

Spherical silver halide crystals have a ratio of smallest to largest dimension that is between 1.0:1.1 and 1.0:1.0. Plate-like silver halide crystals have an aspect ratio of at least 1.0:2.0.

In addition to emulsion layers, the photographic silver halide recording material can contain auxiliary layers on both sides of the substrate such as, for example, bonding layers, protective layers, intermediate layers, anti-static layers as well as layers containing dyes.

The layer which is furthest from the substrate and which does not contain any silver halide is designated as the protective layer. In addition to binders and surface-active substances, such protective layers can optionally also contain other substances which influence the chemical, physical and mechanical properties of the photographic silver halide recording materials. Examples of these substances are lubricants, surface-active substances containing perfluoro-alkyl groups, lattices (polymeric organic particles), fine-particle crystalline $SiO_2$ dispersions, matting agents (spacers), curing agents, anti-static substances as well as preservatives.

The binder coating weight usually lies between 0.5 g/M$^2$ and 4.0 g/M$^2$ for emulsion layers, between 0.5 g/M$^2$ and 5.0 g/M$^2$ for protective layers, and between 0.1 g/M$^2$ and 5.5 g/M$^2$ for intermediate layers.

The photographic emulsions can be produced according to various methods on the basis of soluble silver salts and soluble halides.

During the production and/or physical ripening of the silver halide emulsion, metal ions such as, for example, those of cadmium, zinc, thallium, mercury, iridium, rhodium and iron or their complexes can be present.

The silver halide emulsion can contain silver halide crystals consisting of silver bromide, silver bromo-iodide, silver chlorobromo-iodide or silver chlorobromide. Preferably, a silver halide emulsion is used which contains silver bromo-iodide with a proportion of 5% iodide at the maximum, with respect to the halide proportion.

After crystal formation has been completed, or else already at an earlier point in time, the soluble salts are removed from the emulsion, for example, by noodle-washing, by flocculation and washing, by ultrafiltration or by means of ion exchangers.

The silver halide emulsion is generally subjected to a chemical sensitization under defined conditions (i.e. pH, pAg, temperature, gelatin concentration, silver halide concentration and sensitizer concentration) until the sensitivity and fog optimum values are reached. With chemical sensitization, chemical sensitizers can be used such as, for example, active gelatin, sulfur, selenium, or tellurium compounds, salts or complexes of gold, platinum, rhodium, palladium, iridium, osmium, rhenium, ruthenium, either alone or in combination. Processes are described, for instance, in H. Frieser, "Die Grundlagen der Photographischen Prozesse mit Silberhalogeniden" [The principles of photographic processes with silver halides], pages 675–734, published by Akademische Verlagsgellschaft (1968) or in T. H. James, The Theory of the Photographic Process, 4th edition, Macmillan Publishing Co., Inc., New York, pages 149–160 and in the publications cited therein.

For the production of the photographic silver halide recording materials according to the invention, the layers containing hydrophilic binders can contain organic or inorganic curing agents. The curing of a layer can also be brought about in that the layer to be cured is coated with a layer containing a diffusable curing agent such as described, for example, in DE-A 3,836,945. The curing agent can be added in the course of the production of emulsion solutions and/or of coating solution for auxiliary layers. Another possible mode of addition is the injection of a solution of the curing agent into at least one emulsion or coating solution during its transport from the supply vessel to the coating installation.

Examples of such curing agents that can be used in photographic recording materials are chromium salts such as chromium alum, aldehydes such as formaldehyde, glyoxal and glutaric dialdehyde, N-methylol compounds such as N,N'-dimethylol urea, compounds with reactive vinyl groups such as 1,3-bis-(vinyl sulfonyl)-2-propanol, bis-(vinyl sulfonyl) methyl ether, N,N'-N"-tris-acryloyl hexahydrotriazine, polymeric curing agents such as, for example, those described in U.S. Pat. No. 4,508,818, 1,3-bis-carbamoyl imidazolium compounds such as those described in DE-B 4,119,982 or carbamoyl pyrimidium compounds such as those described, for example, in U.S. Pat. No. 3,880,665.

The silver halide emulsions can contain spectral sensitizers such as, for instance, cyanine dyes, merocyanine dyes, hemicyanine dyes, styryl dyes. A spectral sensitizer can be used either alone or in combination.

The silver halide emulsions can contain substances to stabilize the emulsion from fog formation or to stabilize other photographic properties; these substances can include, for example, benzothiazolium salts, nitroindazoles, nitrobenzimidazoles, mercaptothiazoles, mercaptobenzothiazoles, mercaptobenzimidazoles, mercaptothiadiazoles, chlorobenzimidazoles, bromobenzimidazoles, aminotriazoles, benzotriazoles, nitrobenzotriazoles, mercaptopyrimidines, mercaptotriazines, thioketo compounds such as, for example, oxazolinthione, azaindenes such as triazines and tetraazaindene, like the especially preferred 5-hydroxy-7-methyl-1,3,3a,4-tetraazaindene, and mercaptotetrazoles such as, for example, 1-phenyl-5-mercaptotetrazole on their own or in combination with other substances of this group.

The silver halide emulsion as well as the mixtures for the production of the auxiliary layers can contain surface-active substances for various purposes, such as coating aids for preventing electrostatic charging, for improving the gliding properties, for emulsifying the dispersion, for preventing adhesion and for improving photographic characteristics (for example, development acceleration, high contrast, sensitization). In addition to natural surface-active compounds such as, for example saponin, mainly synthetic surface-active compounds (surfactants) are used: non-ionic surfactants containing oligo- or poly-oxyalkylene groups, glycerin compounds and glycidol compounds, cationic surfactants, for example, higher alkylamines, quarternary ammonium salts, pyridine compounds, and other heterocyclic compounds, sulphonium compounds or phosphonium compounds, anionic surfactants containing an acid group, for example, a carboxylic acid ester group, a phosphoric acid ester group, a sulfuric acid ester group or a phosphoric acid ester group, ampholytic surfactants such as, for example, amino acid and amino sulfonic acid compounds as well as sulfuric acid ester and phosphoric acid ester of an amino alcohol.

The various layers of the photographic recording material can contain filter dyes such as oxonol dyes, hemioxonol dyes, styryl dyes, merocyanine dyes, anthraquinone dyes, cyanine dyes, azomethine dyes, triaryl methane dyes, phthalocyanines and azo dyes.

The carrier of the photographic recording material can consist of a transparent plastic sheet and optionally of a plastic sheet dyed blue. This plastic sheet was made of polyethylene terephthalate, cellulose acetate, cellulose acetate butyrate, polystyrene or polycarbonate.

The surface of the carrier is preferably treated by means of a corona discharge before its first coating in order to improve the adhesion properties.

Various coating processes can be used for the production of the photographic recording material. Examples of these are curtain coating, cascade coating, immersion coating, rinse coating and slot-die coating. If desired, several layers can be applied at the same time.

A general overview of photographic silver halide emulsions, their production, additives, processing and use is provided in Research Disclosure, Vol. 308, Number 308119, 1989 as well as in "Ullmann's Encyclopedia of Industrial Chemistry", Volume 20A, pages 1 through 159, published by VCH Verlagsgesellschaft Weinham, Germany, 1992, and in the sources cited therein. Research Disclosure is published by Kenneth Mason Publications Ltd., Dudley Annex, 21 a North Street, Elmsworth, Hampshire P010 7DQ, England.

Standard procedures for exposing and processing as well as for quality assurance in radiological practice are described in "Bildqualitat in der Rontgendiagnostik" [Image quality in X-ray diagnostics], published by H.-S. Stender and F.-E. Stieve, Deutscher Arzte-Verlag, Cologne, Germany, 1990.

Another advantage of the fast-processing photographic recording materials according to the invention lies in the fact that they display a comparable sensitometry after a processing time of 90 seconds as well as after a processing time of less than 60 seconds.

The fast-processing photographic silver halide recording material according to the invention also exhibits an improved visual resolution, an improved picture silver color, an especially good wet scratch-resistance as well as improved wet printing properties.

EXAMPLES

A silver halide emulsion A was produced using spherical silver bromide-iodide grains (2% iodine proportion) having a mean grain volume of 0.09 $mm^3$, whereby the ratio of the weight percentages of binders to silver was 1.4. The emulsion and a mixture to produce a protective layer were uniformly applied on both sides of a polyester substrate provided on both sides with an adhesive layer, after which they were dried. The mixture for the production of a protective layer consisted of an aqueous gelatin solution and also contained wetting agents and formaldehyde as the curing agent. The layers on both sides of a film sample had the same silver and binder coating weight, and were each cured with the same amount of curing agent. In this process, the amount of curing agent used and the wet coating weight of the two layers were selected in such a way that the silver coating weight and the process water absorption values shown in Table 1 for the two film samples A1 and A2 as well as a gelatin coating weight of 1.2 $g/M^2$ on each side of the protective layer were achieved.

Moreover, a silver halide emulsion B was produced using spherical silver bromide-iodide grains (2% iodide proportion) having a mean grain volume of 0.22 $mm^3$, whereby the ratio of the weight percentages of binders to silver was 1.15. The emulsion, together with a mixture to produce a protective layer over the emulsion layer containing primarily gelatin and using formaldehyde as the curing agent, was applied onto the film samples B1 and B2 in the manner as described for film samples A1 and A2 and subsequently dried, so that the silver coating weights and process water absorption values compiled in Table 1 were achieved and the gelatin coating weight of the protective layer was 1.36 $g/M^2$ on each side.

In each case, the mean grain volume was determined by means of the process described in German Pat. No. 2,025,147.

The process water absorption values of the film samples were determined by first taking a sheet of the recording material to be examined without cast edges or uncast sites, and first exposing it over its entire surface to an intensity corresponding to the saturation range of the characteristic curve, then processing it with a Kodak Processor, Type M8 roll processor, in which the rear cover and the upper deflection roll behind the hydration unit were removed, filled with a developer solution and with a fixing bath having the formula composition:

| Developer: | |
|---|---|
| Hydroquinone | 24.0 g/l |
| Phenyl Pyrazolidone | 0.75 g/l |
| Sodium Sulfite, anhydrous | 60.0 g/l |
| Sodium metaborate | 33.0 g/l |
| Sodium hydroxide | 19.0 g/l |
| Potassium Bromide | 10.0 g/l |
| 6-nitrobenzimidazole | 0.5 g/l |
| Disodium salt of ethylene diamine tetraactic acid | 3.5 g/l |
| Glutaric aldehyde sodium bisulfite | 15.0 g/l |
| Sufficient water to reach a volume of | 1 liter |
| Fixer: | |
| Ammonium thiosulfate | 130 g/l |
| Sodium sulfite, anhydrous | 10.0 g/l |
| Boric acid | 7.0 g/l |
| Acetic acid (90% by weight) | 5.5 g/l |
| Sodium acetate trihydrate | 25.0 g/l |
| Aluminum sulfate × 18 $H_2O$ | 9.0 g/l |
| Sulfuric acid (60% by weight) | 5.0 g/l |
| Sufficient water to reach a volume of | 1 liter |

by means of the RP process (90 seconds passage time; developing bath temperature of 34° C. [93.2° F.]) and removed immediately after the hydration, weighed in the wet state, dried and weighed once again in the dry state. The weight difference, divided by the surface, is given as the absorption of process water by the recording material in grams of water per square meter of film.

TABLE 1

| Film Sample | A1 | A2 | B1 | B2 |
|---|---|---|---|---|
| Ag Application ($G/M^2$) | 4.4 | 5.2 | 5.2 | 6.0 |
| Binder/Ag | 1.4 | 1.4 | 1.15 | 1.15 |
| Process water absorption ($g/M^2$) | 25 | 15 | 27 | 19 |

The sensitometric data for the sensitivity, maximum density (D-max) and mean gradient were obtained by means of standardized exposure and processing, and they are shown in Tables 2 and 3. In this context, numerical values in parenthesis mean that the film did not leave the developer adequately dry and thus that the measured data is not suitable for a direct comparison.

TABLE 2

| Film Sample | A1 | | A2 | |
|---|---|---|---|---|
| Processing time (s) | 90 | 53 | 90 | 53 |
| Sensitivity (%) | 100 | (93) | 100 | 97 |
| D-max (%) | 100 | (92) | 92 | 94 |
| Mean Gradient (%) | 100 | (103) | 100 | 88 |

Table 2 contains a comparison of important sensitometric data in processing cycles of 90 and 53 seconds of the two film samples A1 and A2.

TABLE 3

| Film Sample | B1 | | B2 | |
|---|---|---|---|---|
| Processing time (s) | 90 | 53 | 90 | 53 |
| Sensitivity (%) | 100 | (100) | 95 | 95 |
| D-max (%) | 100 | (100) | 96 | 95 |
| Mean Gradient (%) | 100 | (90) | 97 | 88 |

Table 3 contains a comparison of important sensitometric data in processing cycles of 90 and 53 seconds of the two film samples B1 and B2.

In contrast to the films samples A1 and B1, the film samples A2 and B2 are dry as they leave the film developer after a processing time of 53 seconds and they each have a sensitometry that is suitable for radiological use. After processing during the two processing times employed, the two film samples A2 and B2 each had comparable sensitometric values for sensitivity, maximum density and gradation. Both film samples A2 and B2 also have improved wet printing properties as compared to film samples A1 and B1, improved image silver color, that is to say, more towards the neutral, improved pressure sensitization properties, improved noise and improved image sharpness.

What is claimed is:

1. A fast-processing photographic silver halide recording material for medical radiography comprising:

a carrier;

a silver halide emulsion layer applied to both sides of said carrier wherein said silver halide emulsion layer comprises a binder and silver halide grains having a mean grain volume of less than 0.35 $\mu m^3$;

an auxiliary layer coated on said emulsion layer;

a total silver coating weight of at least 5.0 $g/M^2$;

a binder coating weight wherein a weight ratio of said binder coating weight in said silver halide emulsion layer to said total silver coating weight is at least 1.1;

wherein said silver halide recording material has a process water absorption of less than 20 $g/M^2$ and said photographic silver halide recording material is processable within 60 seconds in a roll processor.

2. The fast-processing photographic silver halide recording material according to claim 1, wherein said silver coating weight is at least 5.2 $g/M^2$.

3. The fast-processing photographic silver halide recording material according to claim 2, wherein said silver coating weight is between 5.2 $g/M^2$ and 6.0 $g/M^2$.

4. The fast-processing photographic silver halide recording material according to claim 1, wherein said mean grain volume of said silver halide grains is between 0.05 $mm^3$ and 0.35 $mm^3$.

5. The fast-processing photographic silver halide recording material according to claim 1, wherein said process water absorption of said silver halide recording material is below 18 $g/M^2$.

6. The fast-processing photographic silver halide recording material according to claim 1, wherein said weight ratio is between 1.1 and 1.4.

7. The fast-processing photographic silver halide recording material according to claim 1, wherein said silver halide emulsion comprises spherical silver halide crystals.

* * * * *